US011465723B1

(12) United States Patent
Choi et al.

(10) Patent No.: US 11,465,723 B1
(45) Date of Patent: Oct. 11, 2022

(54) WATER VESSEL WITH PROPULSION ARRANGEMENTS HAVING BI-DIRECTIONAL FLANKING RUDDERS WITH A PROFILE FOR IMPROVED EFFECTIVENESS

(71) Applicant: United States of America as Represented by the Secretary of the Navy, Arlington, VA (US)

(72) Inventors: Jin Keun Choi, North Bethesda, MD (US); Christopher Paul Kent, Alexandria, VA (US); Thad J. Michael, Fairfax, VA (US); David J. Sawyer, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 174 days.

(21) Appl. No.: 17/126,138

(22) Filed: Dec. 18, 2020

Related U.S. Application Data

(60) Provisional application No. 62/949,980, filed on Dec. 18, 2019.

(51) Int. Cl.

| | |
|---|---|
| ***B63H 11/107*** | (2006.01) |
| ***B63B 1/04*** | (2006.01) |
| ***B63H 25/38*** | (2006.01) |
| ***B63B 3/14*** | (2006.01) |
| *B63H 1/14* | (2006.01) |

(52) U.S. Cl.
CPC ..... *B63H 11/107* (2013.01); *B63B 1/04* (2013.01); *B63B 3/14* (2013.01); *B63H 25/38* (2013.01); *B63H 1/14* (2013.01)

(58) Field of Classification Search
CPC ..... B63H 11/107; B63H 25/38; B63H 25/06; B63H 1/14; B63B 1/04; B63B 3/14
USPC ..... 114/162, 163
See application file for complete search history.

(56) References Cited

U.S. PATENT DOCUMENTS

| | | | | |
|---|---|---|---|---|
| 1,717,286 | A * | 6/1929 | Ward | B63H 25/38 114/57 |
| 6,178,907 | B1 * | 1/2001 | Shirah | B63H 25/38 114/163 |
| 7,517,263 | B1 | 4/2009 | Shen et al. | |
| 10,065,725 | B2 | 9/2018 | Myers et al. | |
| 10,464,655 | B2 | 11/2019 | Myers et al. | |
| 10,988,210 | B2 * | 4/2021 | Moerbe | B63B 1/04 |
| 2020/0062367 | A1 * | 2/2020 | Myers | B63H 5/125 |

* cited by examiner

*Primary Examiner* — Anthony D Wiest
(74) *Attorney, Agent, or Firm* — Dave Ghatt

(57) ABSTRACT

One or more propulsion arrangements for water vessels, and in particular propulsion arrangements that include flanking rudders with bidirectional high-lift sections to improve performance, particularly in the reverse direction. The flanking rudders are positioned adjacent a propulsor for directing a slipstream flow when the vessel is travelling in the reverse direction. Each flanking rudder has an elongated profile extending from a first edge to a second edge, and in which each elongated profile has a first bulb portion, a convex middle portion, and a second bulb portion.

8 Claims, 7 Drawing Sheets

Figure 1C
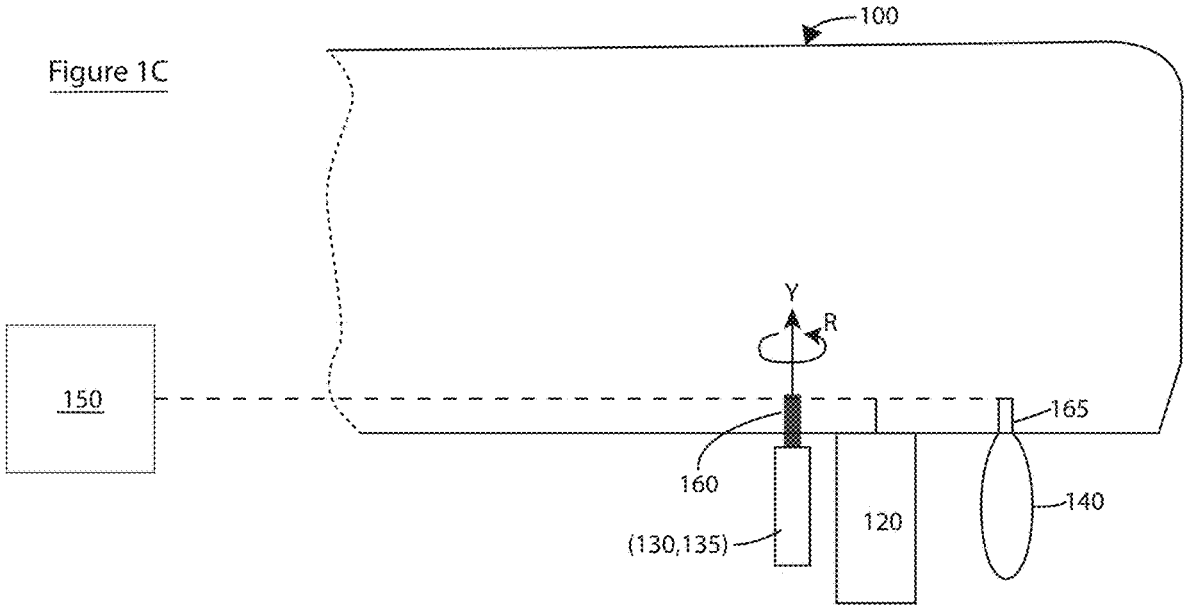
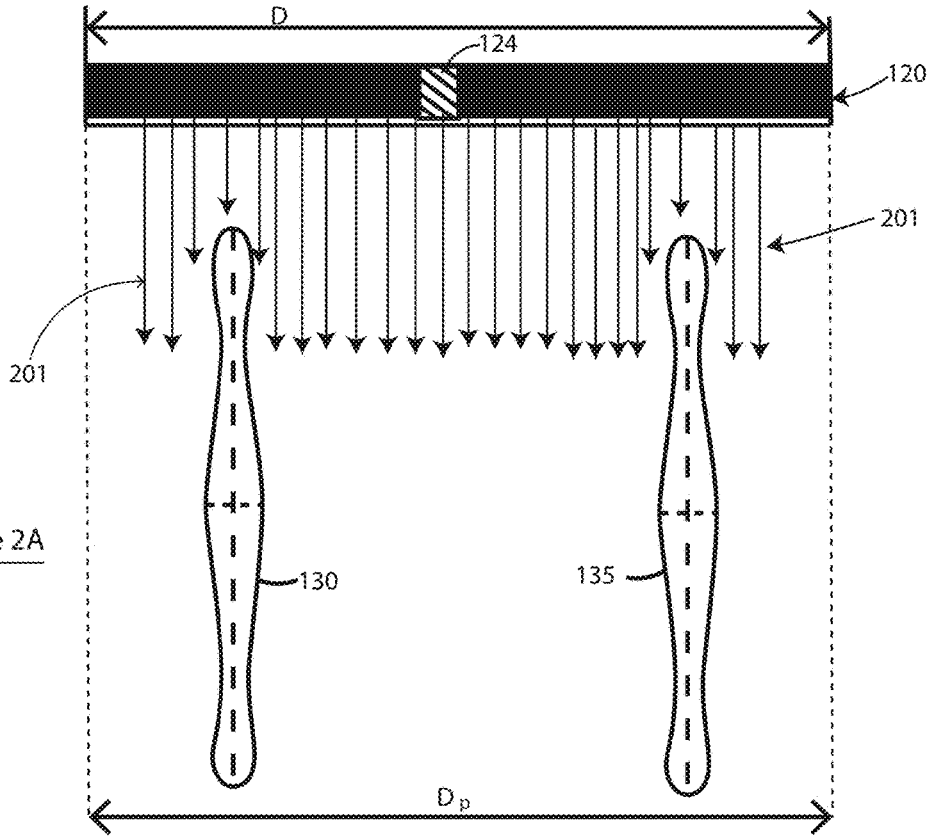
Figure 2A

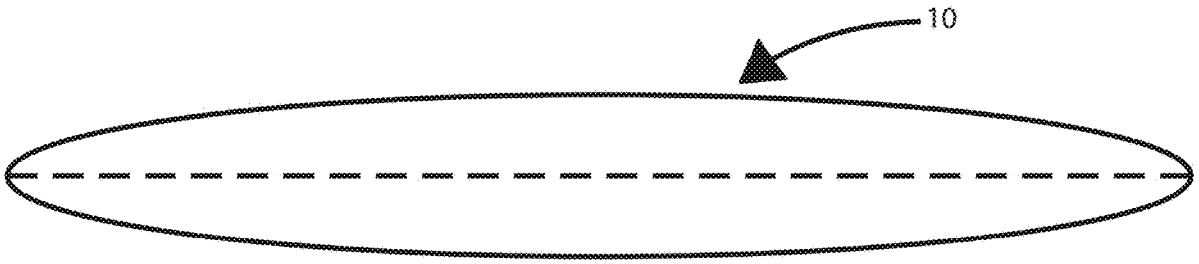
Figure 7 - Prior Art

WATER VESSEL WITH PROPULSION ARRANGEMENTS HAVING BI-DIRECTIONAL FLANKING RUDDERS WITH A PROFILE FOR IMPROVED EFFECTIVENESS

CROSS-REFERENCE TO RELATED APPLICATIONS

This application claims the benefit of U.S. Provisional Application No. 62/949,980 filed Dec. 18, 2019. titled "Flanking Rudders with Bi-Directional High-Lift Sections," incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to water vessels having at least one propulsion arrangement, and in particular at least one propulsion arrangement that includes bi-directional flanking rudders with an edge-to-edge profile for improved effectiveness and performance when travelling in an astern direction.

BACKGROUND

Flanking rudders are commonly used for tugs and other vessels with ducted propulsors to improve the maneuverability of vessels when traveling in the reverse/astern direction. When a propeller-driven craft is backing, flanking rudders are used to improve steering by directing the flow of the jet of fluid accelerated by the propeller from the aft toward the forward end of the craft. By turning this jet of fluid, side forces are generated which turn the craft.

Typically, flanking rudders are constructed of flat plate, with or without stiffeners or a foil aligned to the flow when travelling ahead. FIG. 7 is a sectional illustration of flanking rudders 10 of the prior art. As shown, the flanking rudder sectional is elliptical. These flanking rudders are relatively ineffective at smaller angles when moving astern and they only produce a large side force when the aft end of the rudder meets the outer edge of the propeller duct. Consequently, these prior art flanking rudders provide poor controllability when moving astern, because for a given direction, the steering effect is small until the maximum rudder angle is reached. Additionally, to produce a force in the other direction the flanking rudder must travel all the way to the opposite direction.

Retractable, foil-shaped flanking rudders have been used in some applications. This allows the use of high-lift sections which work well in a single direction. These provide good maneuverability while backing, but are costly to install and require time to deploy. The Navy is constantly searching for advanced technology to improve maneuverability. It is desired to have a flanking rudder design that improves the magnitude of the side forces generated, particularly at angles that are less than maximum.

SUMMARY

In one aspect, the invention is a water vessel having a hull with an underside having a bow end and a stern end. The water vessel has at least one propulsion arrangement. According to the invention, each propulsion arrangement includes a propulsor attached to the underside of the hull at the stern end of the hull, and a pair of flanking rudders adjacent to the propulsor positioned between the bow end of the hull and the propulsor. In this aspect, each of the pair of flanking rudders include a first edge, a second edge, a first minimum thickness area, a maximum thickness area, and a second minimum thickness area. Each flanking rudder also includes an elongated profile extending from the first edge to the second edge. According to the invention, the elongated profile includes a first bulb portion, a convex middle portion, and a second bulb portion, wherein the first bulb portion meets the convex middle portion at the first minimum thickness area, and wherein the second bulb portion meets the convex middle portion at the second minimum thickness area, and wherein the maximum thickness area is in the convex middle portion.

BRIEF DESCRIPTION OF THE DRAWINGS

Other features will be apparent from the description, the drawings, and the claims.

FIG. 1C is a schematic illustration of the control system associated with the propulsion unit, according to an embodiment of the invention.

FIG. 2A is an illustration showing the hydrodynamic positioning of the flanking rudders with respect to the propulsor and the slipstream profile, according to an embodiment of the invention.

FIG. 7 is a sectional view of a flanking rudder, according to what is known in the prior art.

DETAILED DESCRIPTION

Figure 1A:
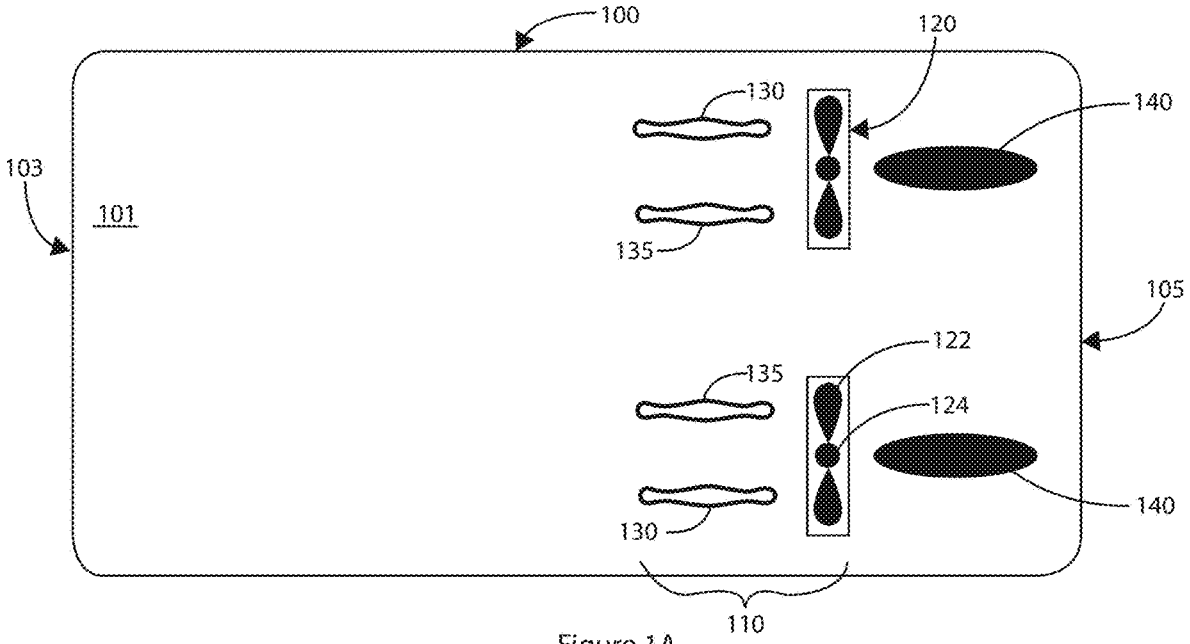
FIG. 1A is a bottom view of a water vessel including propulsion arrangements, according to an embodiment of the invention.

FIG. 1A is a bottom view of a water vessel 100 including propulsion arrangements 110, according to an embodiment of the invention. FIG. 1A shows the underside of the water vessel 100, and provides the general layout of the different elements of the invention. As shown, the water vessel 100 includes a hull having a bow end 103 and a stern end 105. FIG. 1A also shows the water vessel 100 having a propulsion arrangement 110 positioned toward the stem end 105 of the hull 101.

FIG. 1A shows two propulsion arrangements 110. It should be understood that although FIG. 1A shows a water vessel 100 having two propulsion arrangements 110, according to embodiments of the invention the water vessel 100 may have as many propulsion arrangements 110 as necessary. Therefore, for example, it is possible that a water vessel 100 may have only one propulsion arrangement, or three or more propulsion arrangements.

Each propulsion arrangement 110 includes a propulsor 120 attached to the underside of the hull, which may be one or more propellers 122 on a central shaft 124. The one or more propellers 122 and shaft 124 are operably attached to a reversible motor or any other known mechanism for reversing the propeller direction, for thrusting the water vessel 100 in both forward and astern directions. For example, other known reversing mechanisms could include a gearbox assembly, hydraulic coupling mechanisms, or controllable pitch arrangements. FIG. 1A also shows the arrangement having a pair of flanking rudders 130 and 135, adjacent to the propulsor 120. As shown, the flanking rudders 130 and 135 are positioned between the bow end 103 of the hull 101 and the propulsor 120. In the arrangement of FIG. 1A, the flanking rudders 130 are the outboard rudders and the flanking rudders 135 are inboard rudders. As outlined below, the flanking rudders 130 and 135 are bi-directional and have a profile that facilitates improved effectiveness. FIG. 1A shows the arrangement having a main rudder 140 positioned between the stern end 105 of the hull 101 and the propulsor 120.

Figure 1B:
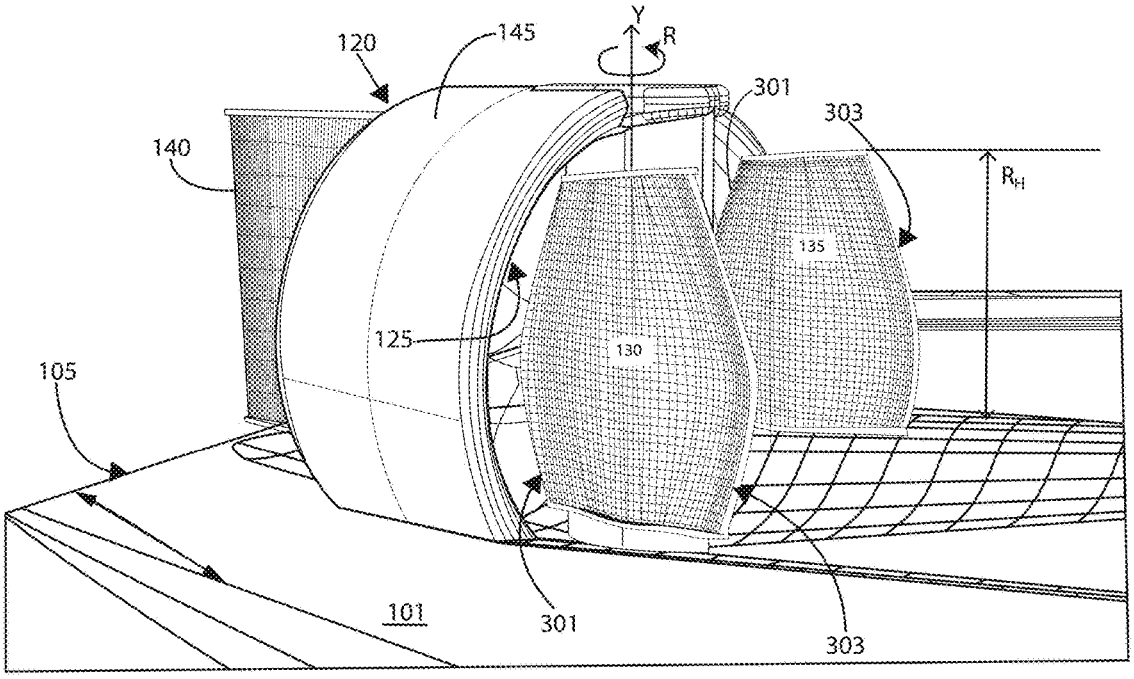
FIG. 1B is a perspective view of the stern end of a water vessel including a propulsion arrangement, according to an embodiment of the invention.

FIG. 1B is a perspective view of the stern end of a water vessel 100 including a propulsion arrangement 110, according to an embodiment of the invention. The perspective view of FIG. 1B is an upside-down view of the propulsion arrangement 110 at the stern end 105 of the hull 101. FIG. 1B also shows the pair of flanking rudders 130 and 135, adjacent to the propulsor 120, as well as the main rudder 140.

As outlined above, FIG. 1A illustrates the general layout of the water vessel 100 and propulsion arrangement 110. FIG. 1B illustrates more clearly, how the elements of the propulsion arrangement are arranged with respect to each other. The perspective view of FIG. 1B shows the propulsor 120 having a propulsor housing 145 that extends over the propulsor 120 forming a protrusion/duct region 125, into which the flanking rudders 130 and 135 extend. FIG. 1B also shows the rudders 130 and 135 having first and second edges. The rudder 130 has a first edge 301 and a second edge 303, and the rudder 135 also has a first edge 301 and a second edge 303. As shown, the first edges 301 of rudders 130 and 135 extend into the duct region 125. As shown the first edges 301 are fayed, i.e., curved in the vertical Y-direction, to accommodate for extension into the duct region 125, and for rotation R, about the Y-axis. It should be noted that according to this embodiment, for uniformity, both sets of first and second edges 301 and 303 are fayed. According to an embodiment of the invention, only the first edges 301 are fayed. As outlined below, there is an embodiment of the invention in which neither of the first or second edges are fayed.

The upside-down FIG. 1B also shows the rudders 130 and 135 having a rudder height $R_H$, in the Y-direction. As shown, the rudders 130 and 135 extend from the base of the hull 101. As stated above, the propulsor 120 includes one or more propellers 122 on a central shaft 124. According to embodiments of the invention, rudder height $R_H$ may be about equal to, or longer than the diameter of the propulsor.

FIG. 1C is a schematic illustration of the control system associated with the propulsion unit, according to an embodiment of the invention. FIG. 1C shows schematically, a controller 150, the flanking rudders 130 and 135 mounted on a rotatable assembly 160. The rotatable assembly 160 may be one or more plates attached to turning bars to provide concurrent rotation of the rudders 130 and 135. Similarly, the main rudder 140 may also be mounted on a main rotatable assembly 165 to provide rotation of the main rudder. As shown, and as outlined above, the rotation is in the direction R about the vertical Y-axis. As shown, the controller 150 is electronically connected to the rotatable assemblies 160 and 165, for controlling the rotation of the rudders 130, 135, and 140. FIG. 1C also shows the controller 150 electronically connected to the propulsor 120 for controlling the reversible power associated with the propulsor 120. Although not illustrated, the controller 150 may also be connected to a plurality of vessel assets to control the overall operation of the water vessel 100. It should be understood that according to an embodiment of the invention, the controller 150 may be a mechanical arrangement having structures connecting the rudders to a steering device such as a wheel or lever, for example.

As outlined above, the propulsor 120 may be a propeller arrangement equipped with a reversible motor, a gearbox assembly, hydraulic coupling mechanisms, controllable pitch arrangements, or any other known mechanism/controls for thrusting the water vessel 100 in both forward and astern directions. As stated above, the forward/reverse direction and power of the propulsor 120 is controlled via the controller 150. When operating in the forward direction, the propulsor creates a forward flow slipstream, which flows in a general direction from the propulsor towards the stern of the vessel. When operating in the reverse/astern direction, the propulsor creates a reverse flow slipstream, which flows in a general direction from the propulsor towards the bow of the vessel.

FIG. 2A is an illustration showing the hydrodynamic positioning of the flanking rudders 130 and 135 with respect to the propulsor 120 and the reverse flow slipstream profile, according to an embodiment of the invention. FIG. 2A shows the propulsor 120 having a propulsor diameter D, which according to this embodiment is the length of a propeller 122, end to end. In the illustration of FIG. 2A, the propulsor 120 is operating in a reverse direction to move the water vessel in the astern direction. FIG. 2A also shows the reverse flow slipstream 201. As shown, the flanking rudders 130 and 135 are positioned within the slipstream 201, and within a downstream projection $D_P$ of the propulsor diameter. It should be understood that D is equal to $D_P$.

Figure 2B:
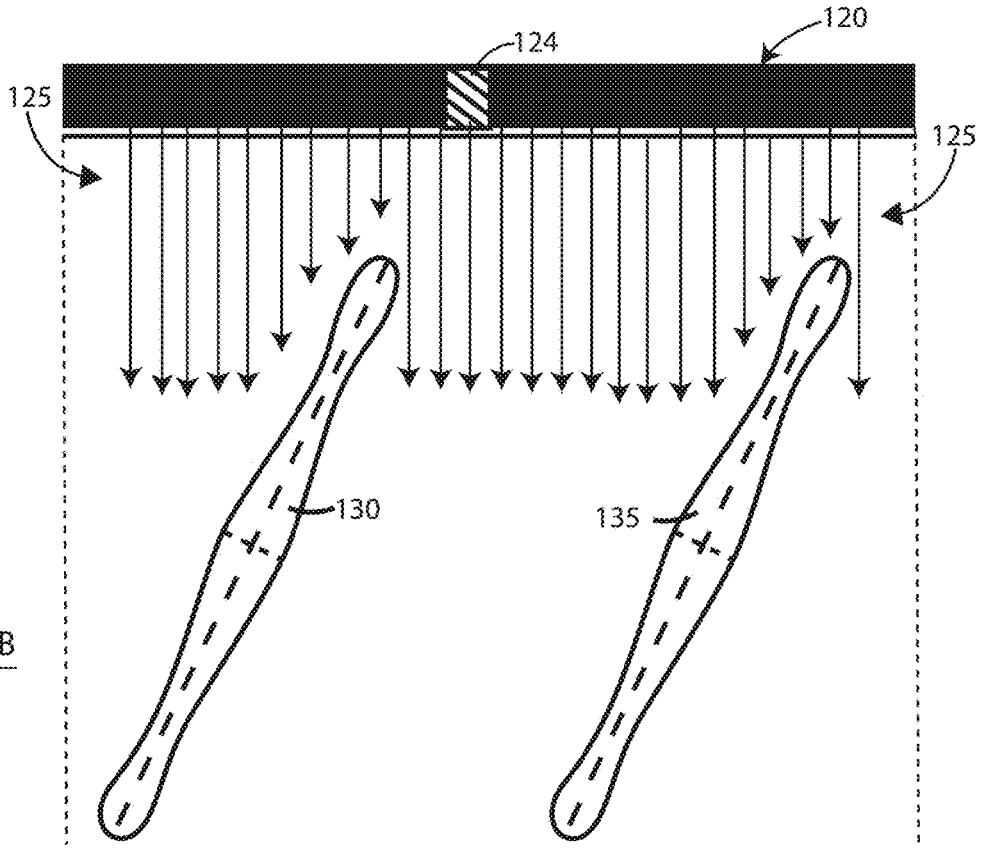
FIG. 2B is an illustration showing the flanking rudders in turning positions, within the reverse flow slipstream, according to an embodiment of the invention.
Figure 2C:
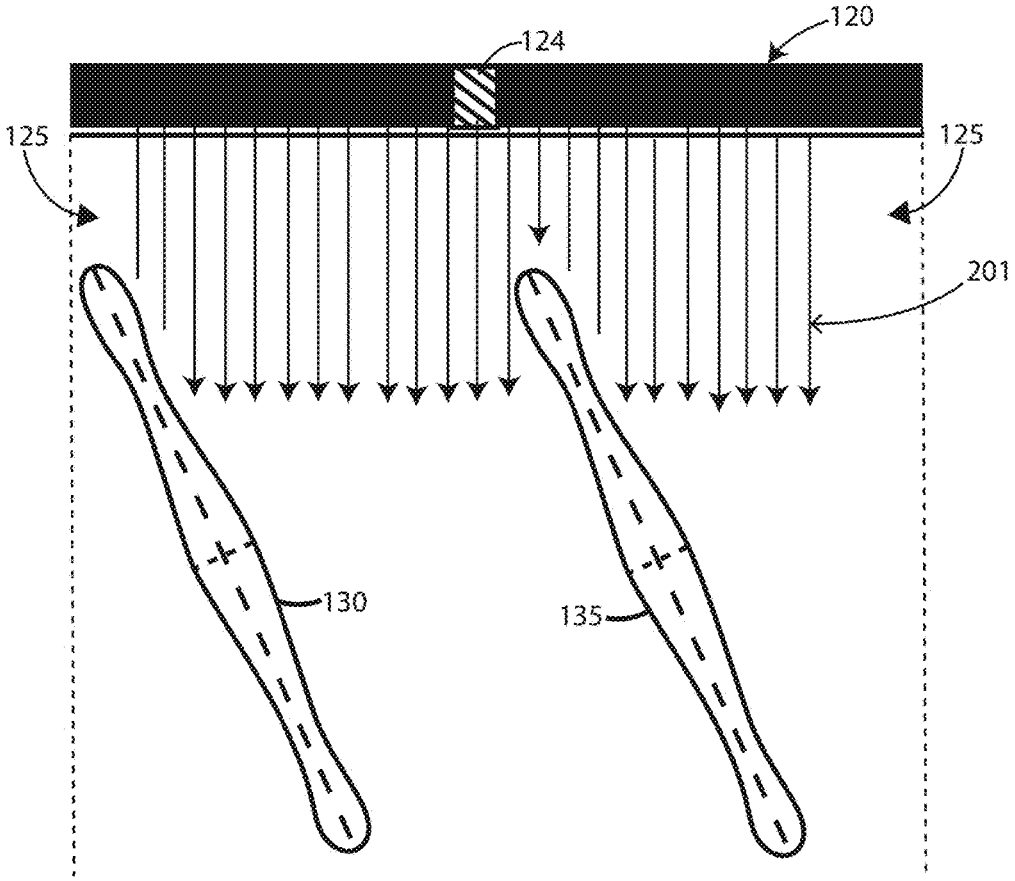
FIG. 2C is an illustration showing the flanking rudders in turning positions, within the reverse flow slipstream, according to an embodiment of the invention.

This positioning of the flanking rudders allows the flanking rudders to effectively guide the water vessel 100 when travelling in the astern direction. The flanking rudders 130 and 135 are rotatable within the reverse flow slipstream 201 to effect the turning of the water vessel when traveling in an astern direction. FIGS. 2B and 2C are illustrations showing the flanking rudders 130 and 135 in turning positions, within the reverse flow slipstream, according to embodiments of the invention. The rotational positioning of the rudders 130 and 135 within the reverse flow slipstream is effected via the controller 150.

Figure 3A:
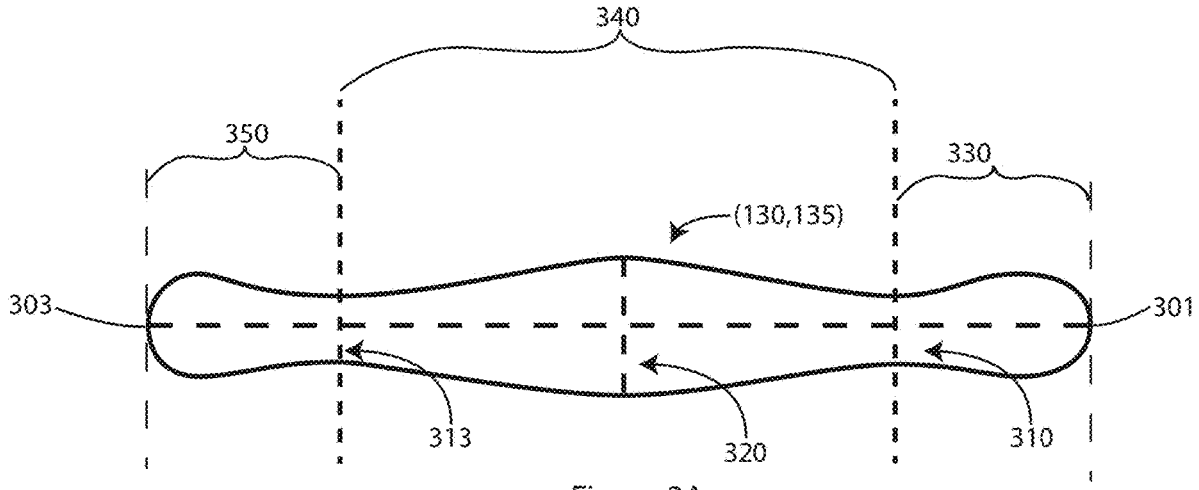
FIG. 3A is a sectional view of a flanking rudder, according to an embodiment of the invention.

FIG. 3A is a sectional view of a flanking rudder, according to an embodiment of the invention. The sectional view of FIG. 3A is representative of both rudders 130 and 135. As outlined herein, the rudders 130 and 135 are bi-directional because the portions as outlined below, are designed for flow in either direction, i.e., forward operation or astern operation. FIG. 3A shows the rudder includes a first edge 301 and a second edge 303. These edges are also shown in FIG. 1B. FIG. 3A also shows the rudder having a first minimum thickness area 310, a second minimum thickness area 313, and a maximum thickness area 320.

FIG. 3A also shows the rudder having an elongated profile extending from the first edge 301 to the second edge 303. As shown, the elongated profile includes a first bulb portion 330, a convex middle portion 340, and a second bulb portion 350. The first bulb portion 330 meets the convex middle portion 340 at the first minimum thickness area 310. FIG. 3A also shows that the second bulb portion 350 meets the convex middle portion 340 at the second minimum thickness area 313. The maximum thickness area 320 is at a central location of the convex middle portion 340.

Figure 3B:
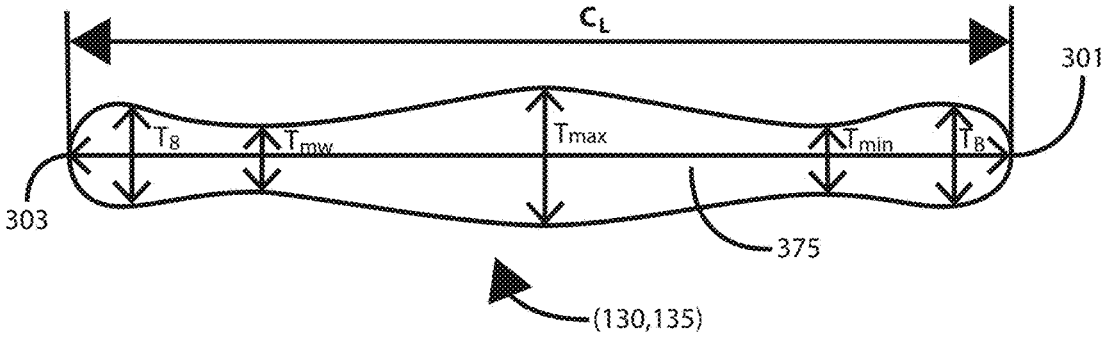
FIG. 3B is a sectional view of a flanking rudder showing relative thicknesses, according to an embodiment of the invention.

FIG. 3B is a sectional view of a flanking rudder showing relative thicknesses, according to an embodiment of the invention. Again, it should be understood that the sectional view of FIG. 3B is representative of both rudders 130 and 135. FIG. 3B also shows the rudder has a chord 375 having a chord length $C_L$, extending from the first edge 301 to the second edge 303. Additionally, each of the first and the second bulb portions 330 and 350 have a bulb thickness $T_B$, at the location at which the bulb is thickest. As shown, the minimum thickness areas 310 and 313 have a thickness $T_{MIN}$ and the maximum thickness area 320 has a thickness $T_{MAX}$. As illustrated, the maximum thickness area 320 is substantially at the center of the convex middle portion 340. According to an embodiment of the invention, the maximum thickness $T_{MAX}$ is 15% to 20% of the chord length $C_L$. According to this embodiment, the bulb thickness $T_B$ is 20% to 60% of the maximum thickness $T_{MAX}$. Additionally, the minimum thickness $T_{MIN}$ is 40% to 60% of the first and second bulb thickness $T_B$.

It should be noted that according to some embodiments of the invention, the flanking rudders 130 and 135 are identical in size. It should also be noted that although the flanking rudders 130 and 135 meet all the percentage ratios outlined with respect to FIGS. 3A and 3B and the outlined relative thicknesses $T_B$, $T_{MAX}$, $T_{MIN}$, with respect each other and with respect to the cord length $C_L$, it is within the scope of the invention that the rudder 130 and 135 have different sizes. For example in arrangements in which there are variations in the depth of the hull 101, it may be required to have slight variations in the sizes of the outboard rudders 130 as compared to the inboard rudders 135.

Figure 4:
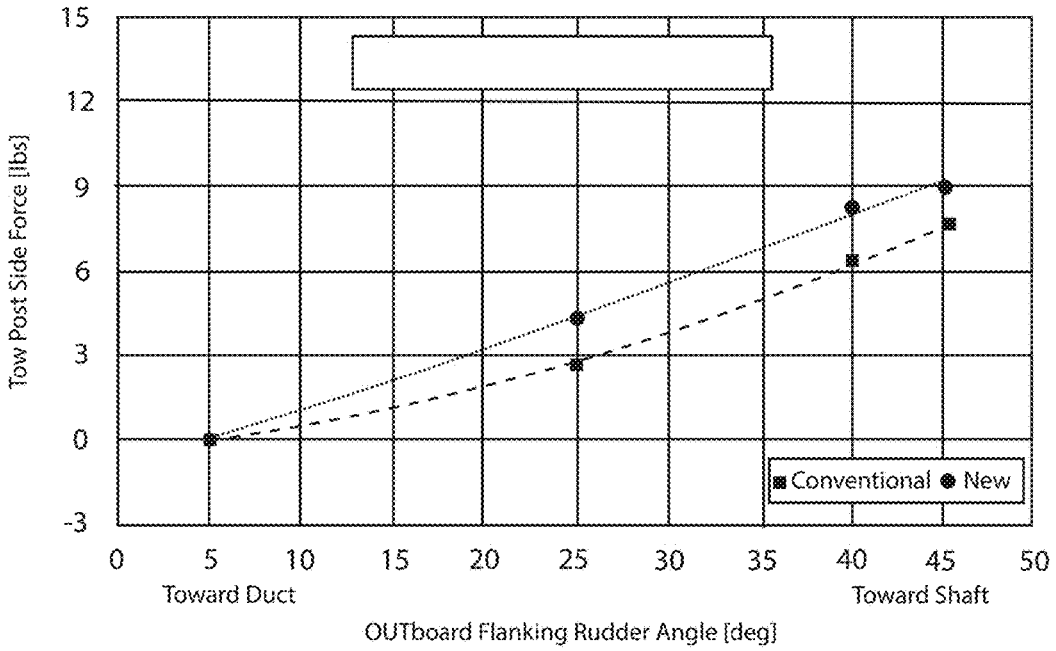
FIG. 4 is a graphical illustration showing operational force results for prior art flanking rudders as compared to the flanking rudders of FIGS. 1A to 3B.

FIG. 4 is a graphical illustration showing operational force results for prior art flanking rudders 10 of FIG. 7 as compared to the flanking rudders 130 and 135 of FIGS 1A to 3B. Thus, the chart of FIG. 4 shows the improvements in effectiveness due to use of the propulsion arrangement 110 that utilizes flanking rudders 130 and 135 as outlined in FIGS. 1A to 3B, as compared to the prior art rudders 10 of FIG. 7. FIG. 4 shows results for an embodiment in which the propulsor 120 is a propeller 122 mounted on a central shaft 124. The side force results of FIG. 4 is the force acting across the beam of the vessel, which directly turns the vessel. The lift is perpendicular to the flow. Because the flow from the propeller is approximately along the length of the hull, the lift force is approximately the same as the side force.

FIG. 4 shows improved lift/side forces (y-axis), for the rudders 130 and 135, which results in more efficient and faster turns when travelling astern. The x-axis shows variations according to the positioning of the rudders, i.e., the angle they are rotated with respect to the central shaft 124 of the propeller 122. As shown, for each rudder 130 and 135, as rotation is measured away from the duct 125, and toward the central shaft 124, there is an improved effectiveness in turning force, as compared to prior art rudders 10 of FIG. 7. It should be understood that because of the arrangement of the pair of flanking rudders 130 and 135, as one of the rudders (130, 135) is rotated toward the central shaft 124, the other of the pair (135, 130) is rotated toward the duct region 125, as the pair is rotated simultaneously.

Figure 5A:
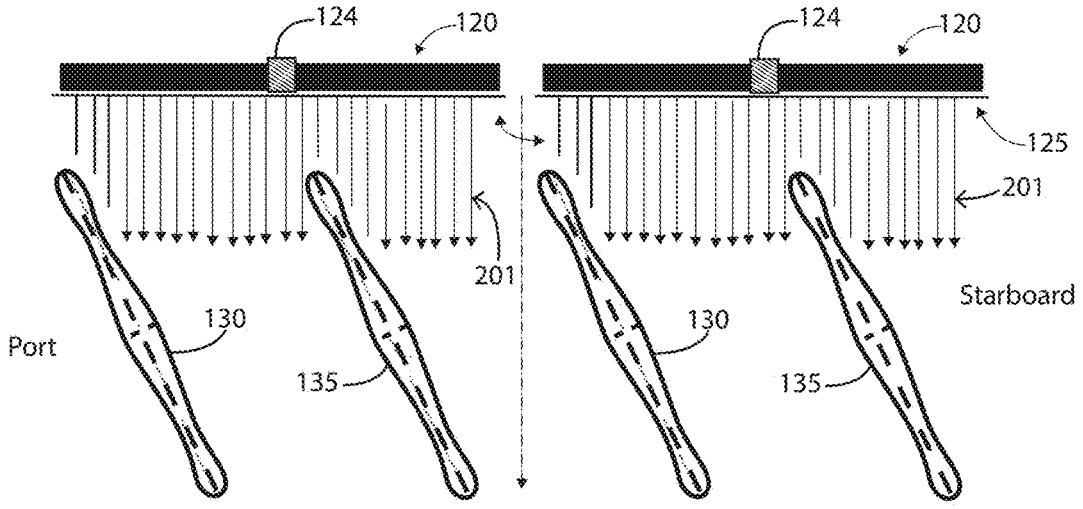
FIG. 5A is an illustration showing the flanking rudders in turning positions in a two-propulsion arrangement, according to an embodiment of the invention.
Figure 5B:
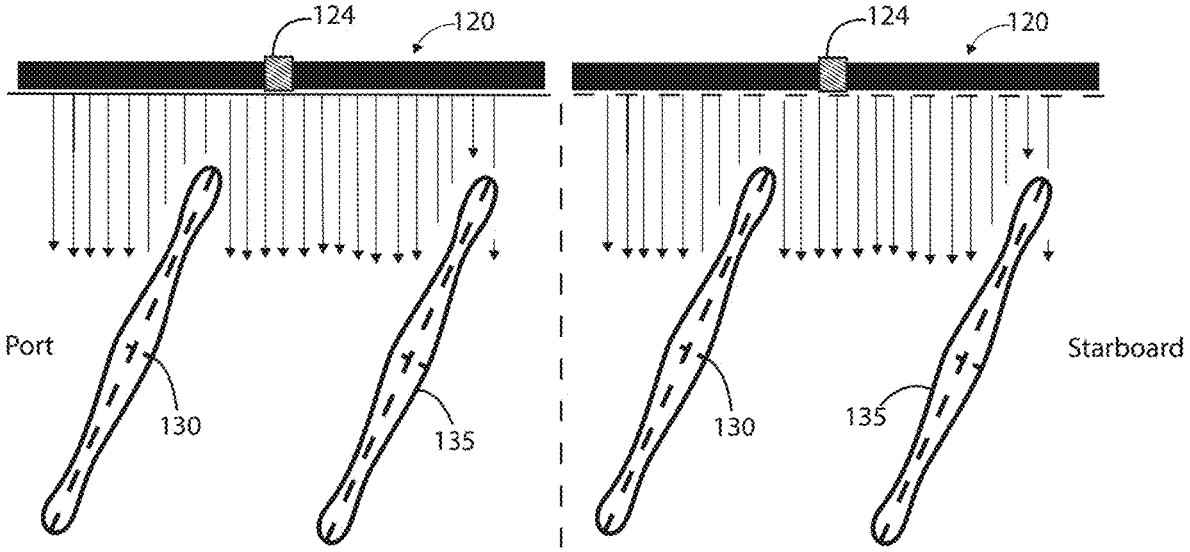
FIG. 5B is an illustration showing the flanking rudders in turning positions in a two-propulsion arrangement, according to an embodiment of the invention.

It should be understood that in an arrangement having two propulsion arrangements 110, both pairs of flanking rudders 130 and 135 are rotated in concert. FIGS. 5A and 5B shows the rudder pairs rotated in unison to turn the water vessel 100, and having the improved effectiveness as shown in graphical illustration of FIG. 4. FIG. 5A shows the first edge of all the rudders directed toward the port side of the water vessel 100. FIG. 5B shows the first edge of all the rudders directed toward the starboard side of the water vessel 100. Regarding FIG. 5A, as the port 130 outboard rudders are rotated toward the duct, the port inboard rudders 135 rotate toward the central shaft 124 and the starboard 130 outboard rudders are rotated toward the central shaft, the starboard inboard rudders 135 rotate toward the duct 125.

Figure 6:
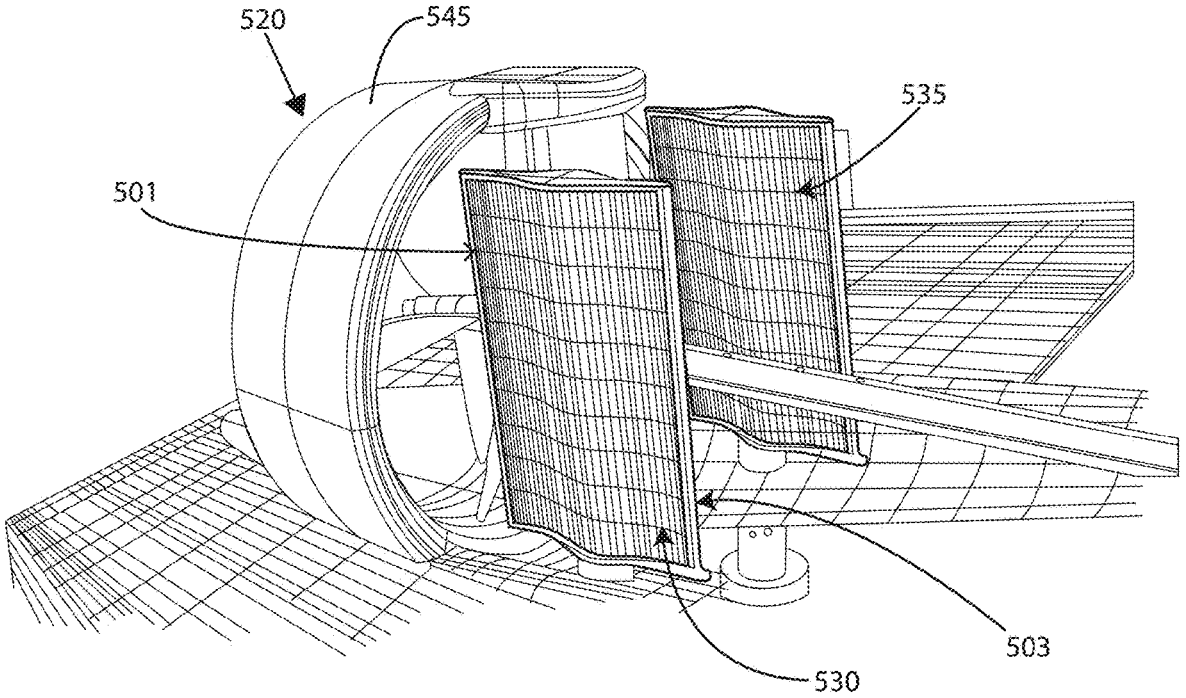
FIG. 6 is a perspective view of the stern end of a water vessel including a propulsion arrangement, according to an embodiment of the invention.

FIG. 6 is a perspective view of the stern end of a water vessel 500 including a propulsion arrangement, according to an embodiment of the invention. The perspective view of FIG. 5 is an upside down view, similar to what is illustrated in FIG. 1B. FIG. 6 also shows the pair of flanking rudders 530 and 535, adjacent to the propulsor 520.

As outlined above. FIG. 1A illustrates the general layout of the water vessel 100 and propulsion arrangement 110. The perspective view of FIG. 5 shows the propulsor 520 having a propulsor housing 545, which extends over the propulsor 520. FIG. 5 also shows the rudders 530 and 535 having first and second edges 501 and 503. As opposed to FIG. 1B in which the edges are fayed or curved in the Y-direction, the edges 501 and 503 are linear, and this the flanking rudders 530 and 535 may have a rectangular shape/outline as shown. It should be understood that the non-fayed flanking rudders 530 may have other shapes/outlines with linear edges, such as trapezoidal, and the like.

It should be understood that the rudders 530 and 535 have profiles as illustrated in FIGS. 3A and 3B, from the first edges 501 to the second edges 503. Therefore, the description of the profile and outlined with respect to FIGS. 3A and 3B, is also a description of the profile of rudders 530 and 535. Therefore, for example, the flanking rudders 530 and 535 have the elongated profile having the first bulb portion 330, the convex middle portion 340, and the second bulb portion 350. Also, the relative thicknesses $T_B$, $T_{MAX}$, $T_{MIN}$, with respect each other and with respect to the cord length $C_L$, is also a description of the profile of rudders 530 and 535. Therefore, according to an embodiment of the invention, the maximum thickness $T_{MAX}$ is 15% to 20% of the chord length $C_L$, the bulb thickness $T_B$ is 20% to 60% of the maximum thickness $T_{MAX}$, and the minimum thickness $T_{MIN}$ is 40% to 60% of the first and second bulb thickness $T_B$.

As shown, the first edges 501 are adjacent to the propulsor 520, which again, may be one or more propellers mounted onto a central shaft. The rectangular rudders 530 and 535 with the linear first and second edges 501 and 503 are ideal for ductless propulsory, as the rotation of the rudders (similar to what is illustrated in FIGS. 2A-2C) is not encumbered by the geometry of a duct. It should be noted that according to some embodiments of the invention, the flanking rudders 530 and 535 are identical in size. It should also within the scope of the invention that the flanking rudders 530 and 535 have different sizes as compared to each other.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention. The invention including the stated variations is intended to be defined by the following claims and their equivalents, in which all terms are meant in their broadest reasonable sense unless otherwise indicated.

What is claimed is:

1. A water vessel comprising:

a hull with an underside having a bow end and a stern end;

at least one propulsion arrangement, wherein each propulsion arrangement comprises:

a propulsor attached to the underside of the hull at the stern end of the hull;

a pair of flanking rudders adjacent to the propulsor positioned between the bow end of the hull and the propulsor, each of the pair of flanking rudders having;

a first edge, a second edge, a first minimum thickness area, a maximum thickness area, and a second minimum thickness area, an elongated profile extending from the fore/first edge to the aft/second edge, wherein the elongated profile comprise, a first bulb portion, a convex middle portion, and a second bulb portion, wherein the first bulb portion meets the convex middle portion at the first minimum thickness area, and wherein the second bulb portion meets the convex middle portion at the second minimum thickness area, and wherein the maximum thickness area is in the convex middle portion.

2. The water vessel of claim 1, wherein each of the pair of flanking rudders comprises a chord having a chord length $C_L$ extending from the first edge to the second edge, and wherein each of the first and the second bulb portions have a bulb thickness $T_B$, wherein the maximum thickness area has a maximum thickness $T_{MAX}$ that is 15% to 20% of the chord length $C_L$, the bulb thickness is 20% to 60% of the maximum thickness $T_{MAX}$, and wherein the minimum thickness area has a minimum thickness $T_{MIN}$ that is 40% to 60% of the first and second bulb thickness $T_B$.

3. The water vessel of claim 2, wherein in each propulsion arrangement, each of the flanking rudders is pivotally mounted to the underside of the hull, and wherein the water vessel further comprises a controller for controlling the rotational motion of each of the flanking rudders.

4. The water vessel of claim 3, wherein each propulsion arrangement is capable of creating a forward flow slipstream and a reverse flow slipstream, the propulsor having a propulsor diameter D, and wherein when a reverse flow slipstream is created, each of the pair of flanking rudders are positioned within the reverse flow slipstream and within an a downstream projection $D_P$ of the propulsor diameter, and wherein the controller controls the rotational positioning of the flanking rudders within the reverse flow slipstream.

5. The water vessel of claim 4, wherein each propulsion arrangement includes a housing enclosure that protrudes over the propulsor forming a duct region, and wherein a portion of each of the flanking rudders extend into the duct region, and wherein each second edge is curved in a vertical direction to allow for said pivotal rotation within the duct.

6. The water vessel of claim 5, the at least one propulsion arrangement comprises two propulsion arrangements.

7. The water vessel of claim 4, wherein each of the flanking rudders has a rectangular or a trapezoidal outline.

8. The water vessel of claim 7, the at least one propulsion arrangement comprises two propulsion arrangements.

* * * * *